US007824143B2

(12) United States Patent
Matsui et al.

(10) Patent No.: US 7,824,143 B2
(45) **Date of Patent: *Nov. 2, 2010**

(54) BOOKBINDING APPARATUS

(75) Inventors: Masaki Matsui, Hachioji (JP); Masato Hattori, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 855 days.

This patent is subject to a terminal disclaimer.

(21) Appl. No.: 11/709,771

(22) Filed: Feb. 23, 2007

(65) Prior Publication Data

US 2008/0056850 A1 Mar. 6, 2008

(30) Foreign Application Priority Data

Aug. 30, 2006 (JP) ..... 2006-233320

(51) Int. Cl.
*B42C 9/00* (2006.01)

(52) U.S. Cl. ..... 412/11; 412/37; 412/33; 156/359; 118/693

(58) Field of Classification Search ..... 412/1, 412/4, 6, 8, 11, 12, 14, 19, 33, 37, 41, 902; 156/350, 351, 359, 578, 908; 118/666, 667, 118/693; 700/299; 270/58.04, 58.09; 198/396, 198/397.01, 606, 626.1, 834
See application file for complete search history.

(56) References Cited

U.S. PATENT DOCUMENTS 4,023,689 A * 5/1977 Taylor et al. ..... 414/327
7,527,465 B2 * 5/2009 Toyoizumi et al. ..... 412/37
2005/0238462 A1 * 10/2005 Oota ..... 412/9
2008/0056847 A1 * 3/2008 Hattori et al. ..... 412/8

FOREIGN PATENT DOCUMENTS

| | | |
|---|---|---|
| JP | 2000-168265 | 6/2000 |
| JP | 2004-209746 | 7/2004 |
| JP | 2004-209870 | 7/2004 |
| JP | 2004-276457 | 10/2004 |

OTHER PUBLICATIONS

Japanese Office Action mailed Sep. 16, 2008.

* cited by examiner

*Primary Examiner*—Dana Ross
*Assistant Examiner*—Pradeep C Battula
(74) *Attorney, Agent, or Firm*—Finnegan, Henderson, Farabow, Garrett & Dunner, L.L.P.

(57) ABSTRACT

A bookbinding apparatus includes: a replenishing device having a pellet storing section that stores pellets of adhesive and a replenishing member that takes out the pellets in a countable manner from the pellet storing section; an adhesive reservoir that melts the pellets replenished from the replenishing member and stores the molten adhesive liquid; a coating device having a coating member that coats the adhesive scooped up from the adhesive liquid; a replenishment sensor that detects the number of pellets replenished to the adhesive reservoir; and a controller that controls the replenishing member based on an output of the replenishment sensor.

5 Claims, 6 Drawing Sheets

BOOKBINDING APPARATUS

This application is based on Japanese Patent Application No. 2006-233320 filed on Aug. 30, 2006, the content of which is hereby incorporated by reference.

BACKGROUND OF THE INVENTION

The present invention relates to a bookbinding apparatus, and in particular, to a bookbinding apparatus that prepare booklets by bonding a plurality of sheets with adhesive.

In the field of light printing, for example, image forming systems are being used widely that prepare booklets from printing to bookbinding in one process by coupling an image forming apparatus having the ability to form images at a high speed such as an electro-photographic image forming apparatus, and a bookbinding apparatus.

Although such image forming systems have low printing speed and low bookbinding speed when compared with the conventional book manufacturing process in which the printing process and the bookbinding process are executed as separate processes, they have the advantage that it is possible to change the content of printing at any time and are on the whole high efficiency image forming systems, and are being used as POD (Print On Demand) systems.

Since a POD system has the image forming apparatus and the bookbinding apparatus coupled to each other, and is not installed in a factory for printing and bookbinding but is very often installed either within an office or in the same building as the office, it has to be small in size, and all parts constituting the system are required to be small in size.

Therefore, even as a bookbinding apparatus is used the type that prepares booklets by binding bundling sheets using adhesive bonding which is a relatively simple process.

A reduced size bookbinding apparatus has been disclosed in Unexamined Japanese Patent Application Publication No. 2000-168265 that prepares a booklet by coating the adhesive by moving the coating roller relative to the longitudinal direction of the spine of the sheet bundle by moving the sheet bundle with respect to the coating roller.

In Unexamined Japanese Patent Application Publication Nos. 2004-209746 and 2004-276457 are disclosed, in a coating apparatus suitable for small-sized bookbinding apparatus, an adhesive replenishing device that carries out replenishment of adhesive at an accurate rate in a simple manner.

In Unexamined Japanese Patent Application Publication Nos. 2004-209746 and 2004-276457 is proposed a replenishing member that transports pellets of adhesive material along an inclined transport path, and by opening or closing a threshold member provided in the transport path, supplies a fixed quantity of pellets of about a few pellets during each replenishment.

In a reduced size adhesive coating apparatus, since the level of the adhesive liquid in the adhesive reservoir varies widely because the volume of the adhesive reservoir that contains the liquid of the adhesive material is small, not only it is required to carry out replenishment of the adhesive accurately but also it is necessary to control the rate of replenishment according to the thickness of the sheet bundle, and a replenishment control that has accuracy and speed is required.

When a replenishment mechanism is used that replenishes in units of a few pellets as in Unexamined Japanese Patent Application Publication Nos. 2004-209746 and 2004-276457, although the replenishment control is carried out by controlling the number of replenishments in units of a few pellets, there was the problem that the accuracy of the replenishment in this type of replenishment control is not sufficient, and also, that the speed of control of meeting speedily the changes in the quantity of adhesive and it was difficult to carry out uniform coating over a long period.

In other words, when there is any disturbance in the unit of replenishment, because the inaccurate replenishment is carried out repeatedly, the replenishment error gets accumulated leading to the condition of excessive or insufficient quantity of adhesive in the adhesive reservoir.

SUMMARY OF THE INVENTION

One aspect of the present invention is as follows. A bookbinding apparatus provided with a replenishing device having a pellet storing section that stores pellets of adhesive and a replenishing member that takes out pellets in a countable manner from the pellet storing section, and in addition, an adhesive reservoir that melts the pellets replenished from the replenishing member and stores the molten adhesive liquid, and a coating device having a coating member that coats the adhesive scooped up from the adhesive liquid. The bookbinding apparatus further has a replenishment sensor that detects the number of pellets replenished to the adhesive reservoir, and a controller that controls the replenishing member based on the output of the replenishment sensor.

DETAILED DESCRIPTION OF THE PREFERRED EMBODIMENT

Although the present invention is described here using a preferred embodiment shown in the figures, the present invention shall not be limited to the preferred embodiment.

Figure 1:
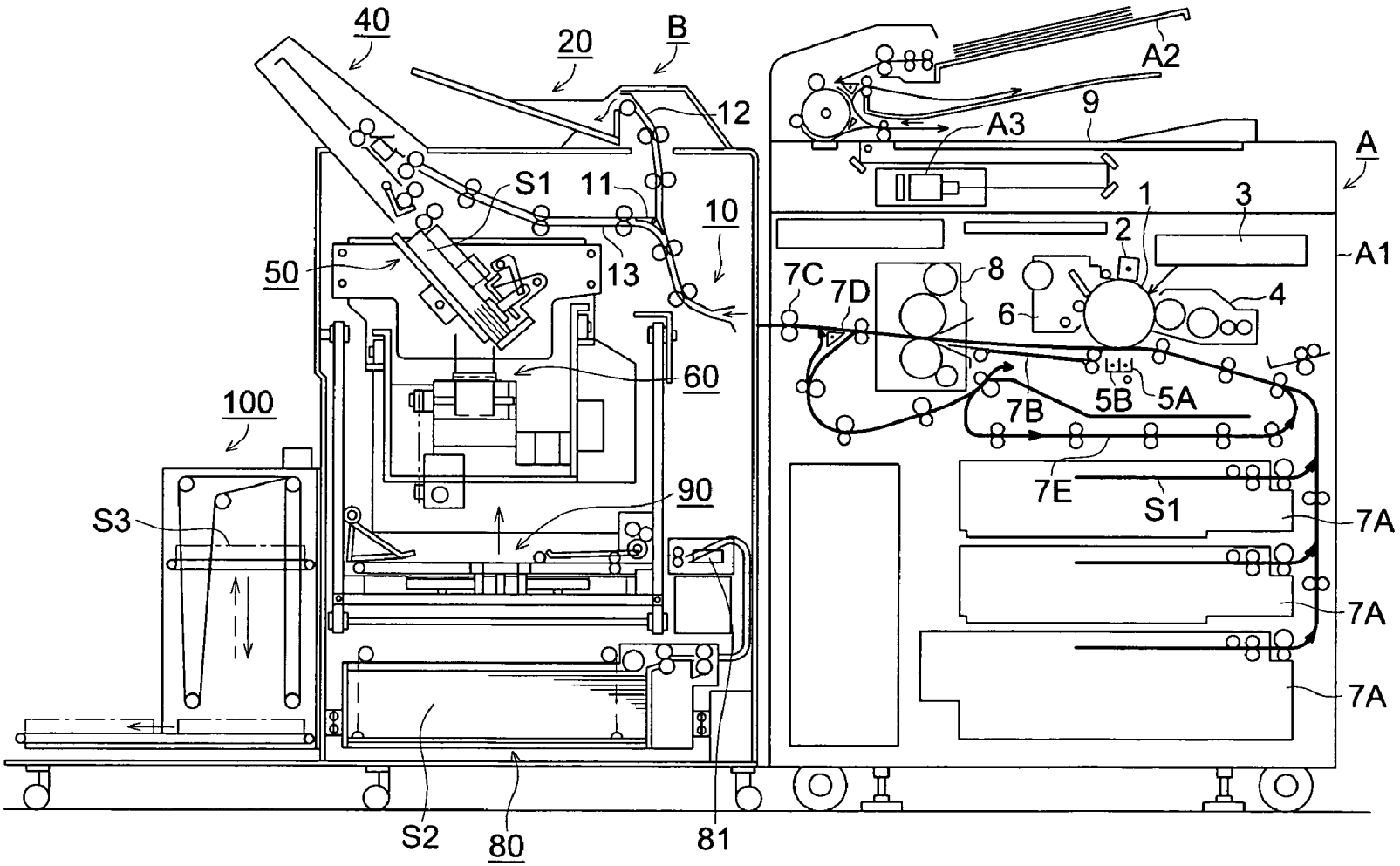
FIG. 1 is a diagram showing an entire image forming system provided with a bookbinding apparatus according to a preferred embodiment of the present invention.

FIG. 1 is a diagram showing an entire image forming system provided with a bookbinding apparatus according to a preferred embodiment of the present invention.

The image forming system has an image forming apparatus A and a bookbinding apparatus B.

The image forming apparatus A is one that forms images on sheets using the electro-photography method, and has an image forming section A1, a document conveying device A2, and an image reading section A3.

In the image forming section A1 are arranged a charging unit 2, an exposure unit 3, a developing unit 4, a transfer unit 5A, a separation unit 5B, and a cleaning unit 6 on the periphery of a drum shaped photoreceptor 1, and using these electrophotographic process devices, a toner image is formed on the photoreceptor 1 and the image is formed on the sheet S1 after charging, exposure, developing, and transfer are carried out.

The sheets S1 are stored in three sheet feeding trays 7A, and one sheet at a time of the sheet S1 is fed from these sheet feeding trays 7A, and the toner image on the photoreceptor 1 is transferred onto the sheet S1 by the transfer unit 5A.

The toner image transferred onto the sheet S1 is fixed by passing through the fixing unit 8. The fixed sheet S1 either is discharged by the ejection roller 7C or is conveyed to the re-feeding path 7E.

During face-down sheet discharge in single-sided printing, face-up sheet discharge in single-sided printing, or front surface image formation in double-sided image formation, the switching gate 7D switches and guides the sheet S1. In other words, during face-up sheet discharge, the switching gate 7D causes the sheet S1 proceeds forward, and in face-down sheet discharge or in double-sided image formation, the switching gate 7D guides the sheet S1 downwards.

During face-down sheet discharge, the sheet S1, after being guided downwards, is switched back and is conveyed in the upward direction, and is then discharged by the ejection roller 7C.

During double-sided image formation, the sheet S1 is guided downwards, after being turned upside down by switching back, it passes through the sheet feeding path 7E, fed to the transfer section in which is placed the transfer unit 5A, and the image of the back surface is transferred onto it.

The document conveying device A2 conveys the document one sheet at a time to the reading position. The image reading section A3 reads out the image of the document conveyed by the document conveying device A2 or the image of the document placed on the document table 9, and generates the image signals. The communication section A4 carries out communication with a network device, receives the image forming command transmitted from the network, and generates the image signals.

The bookbinding apparatus B is an apparatus that stacks a plurality of sheets that constitute a bundle and that are fed from the image forming apparatus A, and configures a bundle to be formed into a book, joins a cover sheet to that the sheet bundle, and prepares a book. In the following explanations, the sheets constituting sheets are called a sheet S1, and the cover sheet is called a cover S2, and the sheets constituting sheets to which a cover sheet has been joined is called a booklet S3.

The bookbinding apparatus B has a conveyance section 10 that conveys the sheets S1 discharged from the image forming apparatus A either to an ejection tray 20 or to a sheet reverse section 40, an ejection tray 20, a sheet reverse section 40, a stacking section 50 that stacks the sheets S1 sent one sheet at a time or several sheets at a time, a coating device 60, a cover sheet storing section 80 that stores the cover sheets S2, a cover sheet supporting section 90 that supports the cover sheet S2, and a booklet ejection section 100.

The sheet S1 discharged from the image forming apparatus A either is discharged to the ejection tray 20 via the ejection path 12 or is conveyed to the sheet reverse section 40 by the switching gate 11 provided in the conveyance section 10. If the mode of operation is not the bookbinding mode, the sheets S1 are discharged to the ejection tray 20.

In the bookbinding mode, the sheets S1 are conveyed to the sheet reverse section 40 via the conveying path 13, and, after being switched back in the sheet reverse section 40, they are conveyed to the stacking section 50. In the stacking section 50, the sheets S1 are stacked until the number of sheets becomes equal to a set number, the stacking section 50 is rotated when the number of sheets stacked becomes equal to the set number, and the bundle of sheets S1 is held in an almost vertical condition.

Adhesive is coated by the coating device 60 on the bottom surface of the bundle of sheets S1 held in the vertical condition by the stacking section 50.

A cover S2 is contacted with and adhered to the bundle of sheets S1 on which adhesive has been coated.

The booklet S3 prepared by adhering the cover sheet S2 to the bundle of sheets S1 is discharged to the booking ejection section 100.

Figure 2:
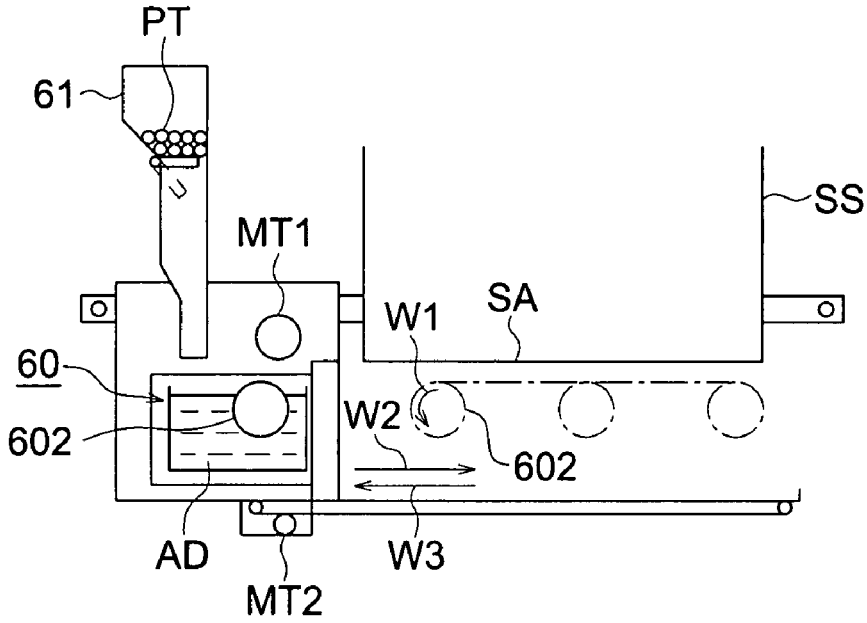
FIG. 2 is a diagram showing a coating process.

FIG. 2 is a diagram showing the coating process.

The coating device 60 is placed below the sheet bundle SS of the sheets S1, and during its forward movement driven by the motor MT2 indicated by the arrow W2, the coating roller 602 coats the adhesive AD on the spine SA of the sheet bundle SS, and during the reverse movement indicated by the arrow W3, the coating roller coats the adhesive AD on the spine SA.

The home position of the coating device 60 is the left end position in FIG. 2, which is located at the deep side of the bookbinding apparatus shown in FIG. 1, and at this home position, pellets PT of the adhesive are replenished from the replenishment device 61. The coating roller 602 is rotated in the direction indicated by the arrow W1 due to the drive of the motor MT1 during the forward and reverse movements thereby scooping up the adhesive from the adhesive reservoir 601 and coats it on the spine SA of the sheet bundle SS.

Figure 3:
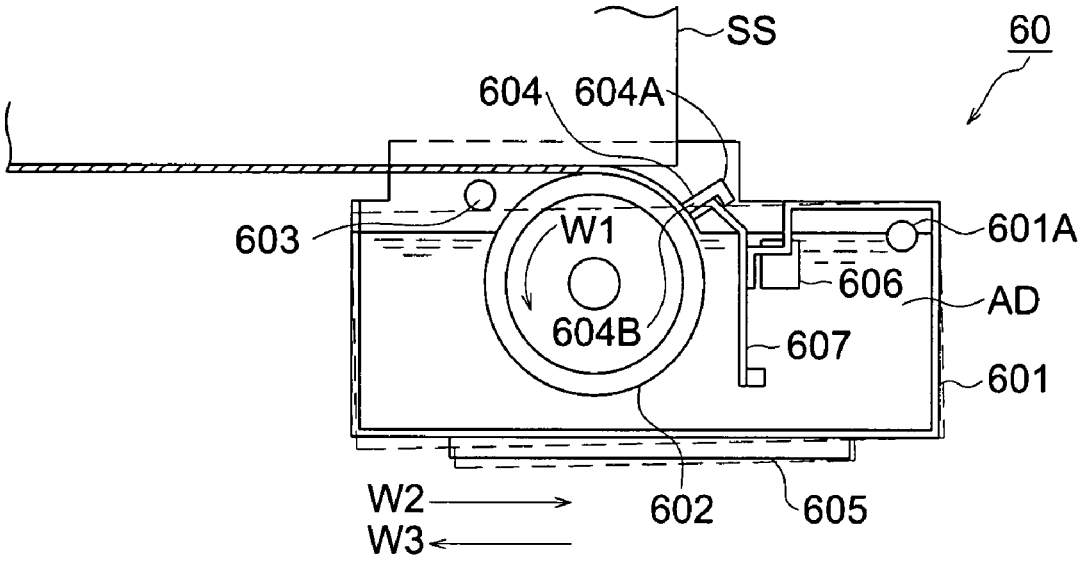
FIG. 3 is a diagram showing the configuration of the coating device 60.

FIG. 3 is a diagram showing the configuration of the coating device 60.

The coating device 60 has an adhesive reservoir 601 that stores the adhesive AD, a coating roller 602, two regulating members 603 and 604, a heater 605, and an adhesive quantity sensor 606.

Although the pellets inside the adhesive reservoir 601 are heated and melted by the heater 605 thereby forming the coating liquid of the adhesive AD, the quantity of the adhesive AD is detected by the adhesive quantity sensor 606 composed of a temperature sensor, and the liquid surface is maintained constant. The part 603 is a regulating member having the shape of a rod with an almost circular cross-section, and the regulating member 604 is supported by a supporting member 607 having the shape of a plate, and limits the thickness of the layer of adhesive above the coating roller 602 using its bottom edge 604B, and restricts the thickness of the adhesive layer on the spine SA of the sheet bundle SS using its top edge 604A.

The adhesive reservoir 601 is set by rotating from the standby state indicated by dotted lines to the coating state indicated by continuous lines around the shaft 601A.

Figure 4:
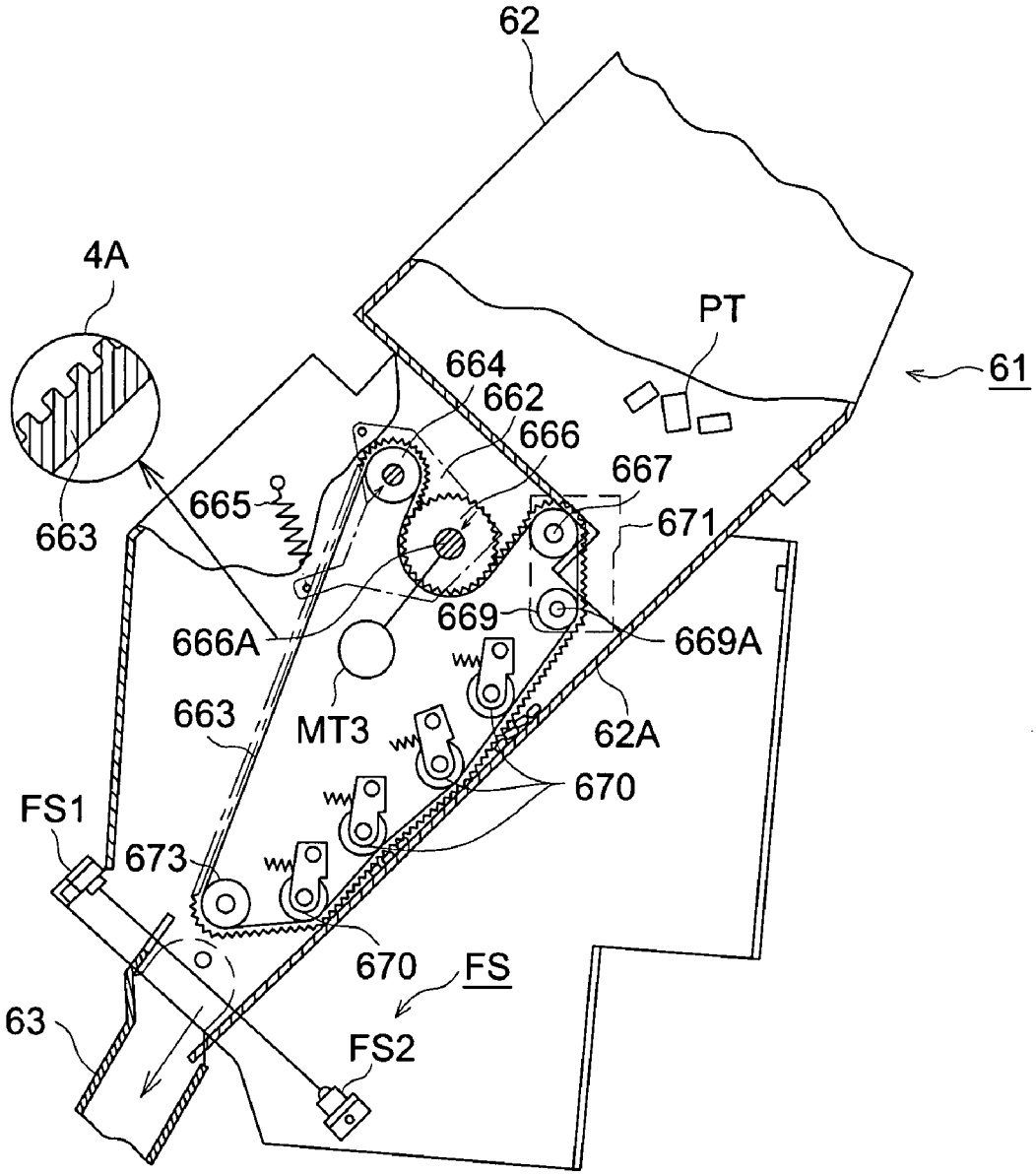
FIG. 4 is a cross-sectional view diagram of the replenishing device 61.
Figure 5:
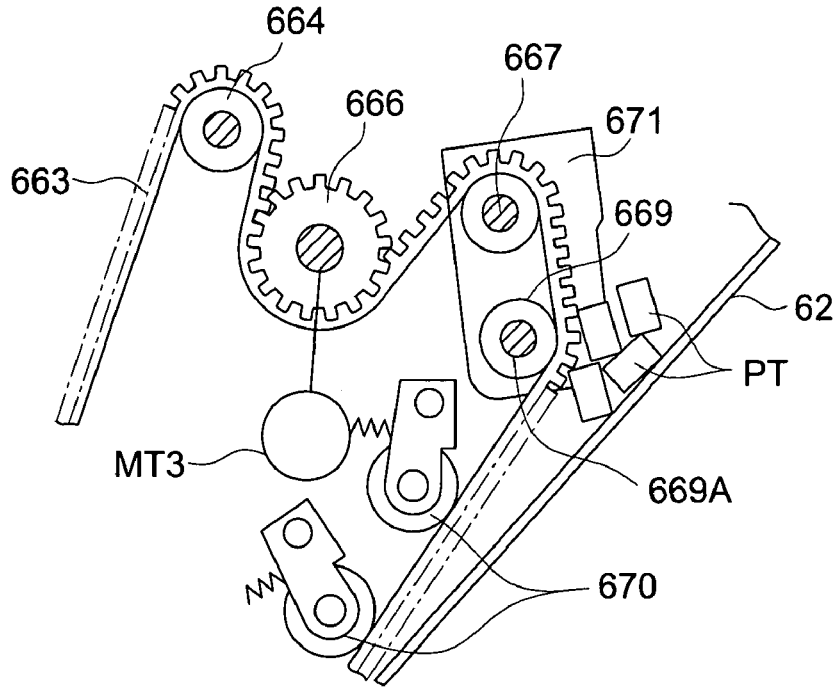
FIG. 5 is a diagram showing important parts of the replenishing device 61 before the operations are started.
Figure 6:
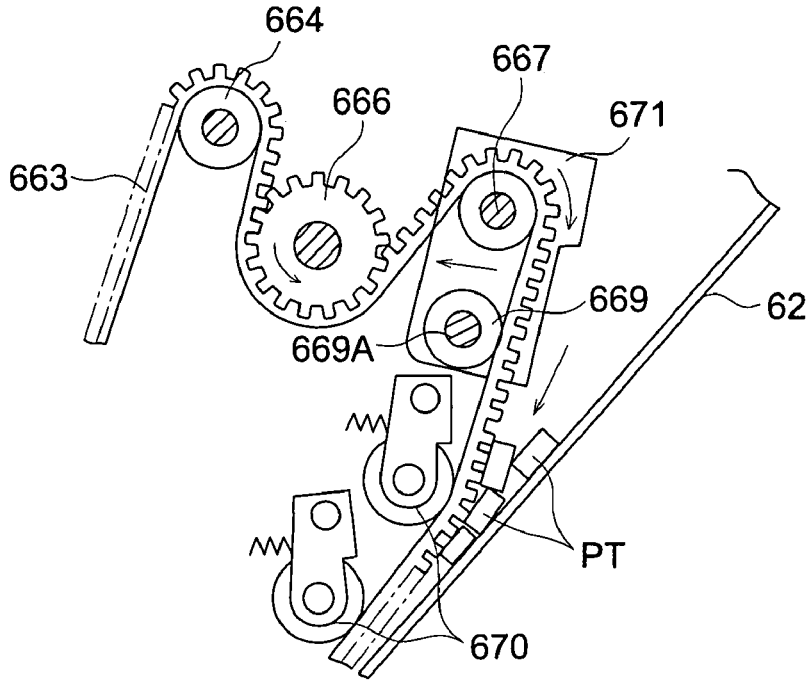
FIG. 6 is a diagram showing important parts of the replenishing device 61 during replenishment.
Figure 7:
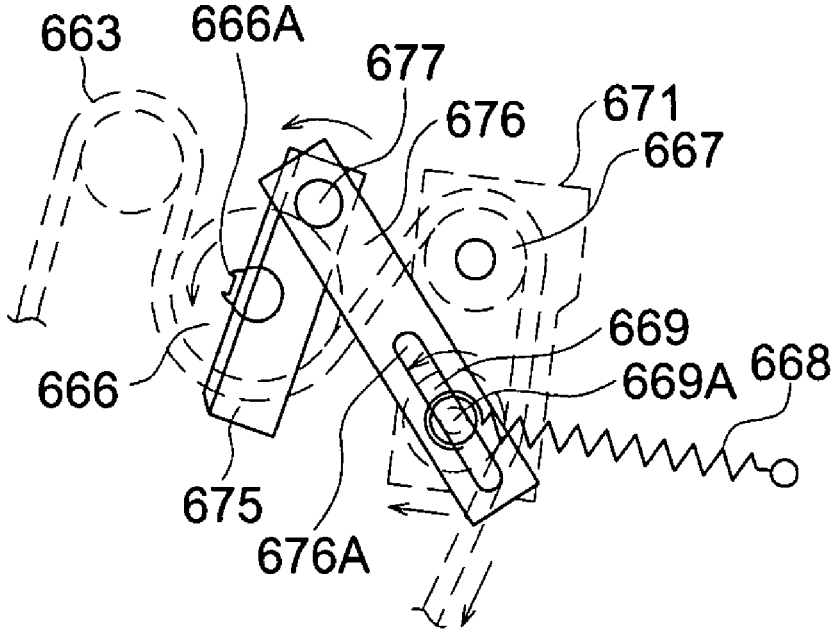
FIG. 7(*a*) and FIG. 7(*b*) are diagrams showing a drive system in the replenishing device 61.
Figure 7:
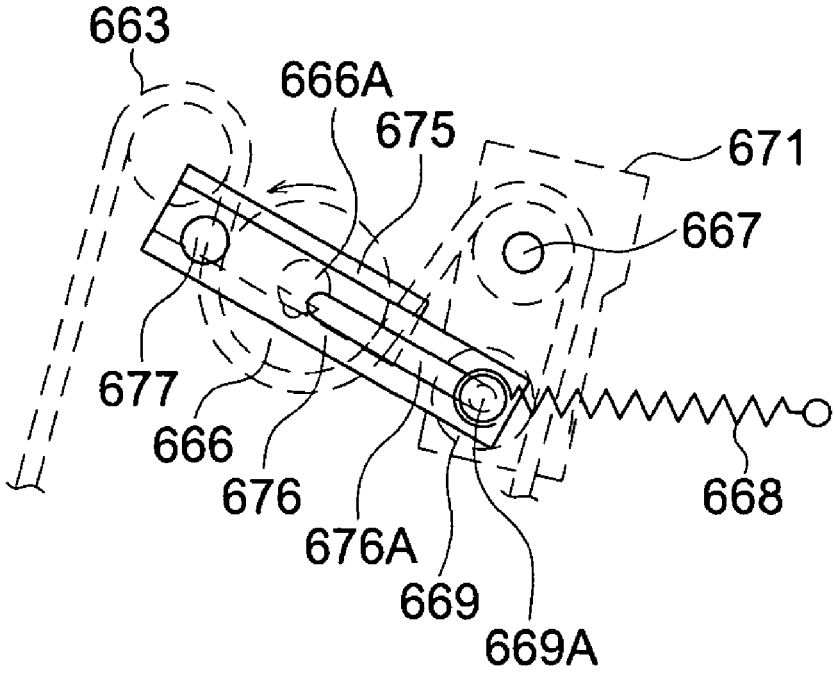

The replenishment device 61 is explained here referring to FIG. 4 to FIG. 7. FIG. 4 is a cross-sectional view diagram of the replenishing device 61, FIG. 5 shows the important parts of the replenishing device 61 before the operations are started, and FIG. 6 shows the important parts of the replenishing device 61 during replenishment. FIGS. 7(*a*) and 7(*b*) show the drive system in the replenishing device 61.

The replenishment device 61 is composed of a hopper 62 as the pellet storing section that stores the pellets PT of the adhesive and the replenishing pipe 63 through which the pellets PT drop, and the frame 62A constituting the hopper 62 supports the different parts described below.

The replenishing device 61 is incorporated into the bookbinding apparatus B in the condition shown in FIG. 4, that is, in the condition in which the hopper 62 and the replenishing pipe 63 are inclined downward towards the left, and the pellets PT drop along the bottom surface of the frame 62A and the bottom surface of the replenishing pipe 63, and are supplied to the coating device 60.

The belt 663 that conveys the pellets PT is entrained about the rollers 664, 666, 667, and 673 in the lower part of the hopper 62. The roller 666 is the drive roller and rotates counterclockwise by being driven by the motor MT3 which is a constituent part of the replenishing member.

The belt 663 which is a constituent part of the replenishing member has concave-and-convex portions formed on its outer peripheral surface as is shown in the enlarge view diagram of 4A, and because of this concave-and-convex surface, not only the pellets are conveyed definitely, but also the area of contact with the pellets PT is made small, thereby preventing adhesion between the pellets PT and the belt 663. Because four pressure rollers 670 press the belt 663 against the frame 62A using the force of springs, the spacing between the frame 62A and the belt 663 is restricted so that it does not become larger than a prescribed limiting value, and because of this, the amount of conveying of the pellets PT by the belt 663 is controlled to be almost constant.

The rollers 664 and 666 are supported by the supporting plate 662 that can swing about the rotating shaft 666A of the roller 666, and the supporting plate 662 is pulled clockwise by a pulling type spring 665. Because of this, a constant tension force is applied to the belt 663 by the roller 664 pulled by the spring 665.

The rollers 667 and 669 are supported by the supporting plate 671 that can swing about the rotating shaft of the roller 667.

The replenishing device 61 in the stopped state before starting operations is as shown in FIG. 5, and in this state, the roller 669 has narrowed the pellet discharge outlet, and the pellets PT stay in the hopper 62 being blocked by the belt 663 supported by the roller 669 as shown in FIG. 5.

When the replenishing device 61 starts operating, the roller 669 moves to the left as shown in FIG. 6, the belt 663 recedes, thereby making wide the pellet discharge outlet of the hopper 62. Because of this, the pellets PT drop up to the discharge outlet, and the pellets PT that have dropped along the bottom surface of the frame 62A due to the conveying action of the belt 663.

During the period when the replenishing device is carrying out replenishing operation, the roller 669 reciprocates between the position shown in FIG. 5 and the position shown in FIG. 6, and because of this reciprocating operation, the pellets PT drop in small quantities at a controlled rate and are supplied to the coating device 60.

The roller 669 is an opening forming member that forms the narrow opening that blocks the discharge of the pellets PT and the wide opening that discharges the pellets PT due to the reciprocating movement. The drive mechanism that makes the roller 669 carry out reciprocating movement is explained using FIG. 7(*a*) and FIG. 7(*b*).

A support plate 675 that rotates integrally with the roller 666 has been fixed to the shaft 666A of the roller 666, and a link 676 has been supported in a rotatable manner to the pin 677 provided at one end of the supporting plate 675.

The shaft 669A of the roller 669 engages with and enters the long hole 676A provided in the link 676.

The shaft 669A of the roller 669 is pulled to the right in FIGS. 7(*a*) and 7(*b*) by a pulling type spring 668. Therefore, the roller 669 is maintained at the prescribed position by the tension force of the belt 663 and the force of the spring 668.

Although the supporting plate 675 rotates due to the rotation of the roller 666, because of the rotation of the supporting plate 675, the right end position of the link 676 moves in the left and right directions in FIGS. 7(*a*) and 7(*b*), and because of this movement, the position of the roller 669 moves in the left and right directions, and hence the pellet discharge outlet of the hopper 62 contracts and expands as is shown in the state in FIG. 5 and the state in FIG. 6.

This contraction and expansion are repeated during the replenishment operation, and the pellets PT are supplied to the coating device 60 in small quantities at a controlled rate.

Returning to FIG. 4, FS is a replenishment sensor that detects the pellets PT falling from the hopper 62, and is composed of a light emitting device FS1 and a light receiving device FS2. The number of pellets PT supplied to the coating device 60 is detected by the replenishment sensor FS. The count of the number of pellets PT by the replenishment sensor FS is proportional to the number of pellets PT replenished.

Figure 8:
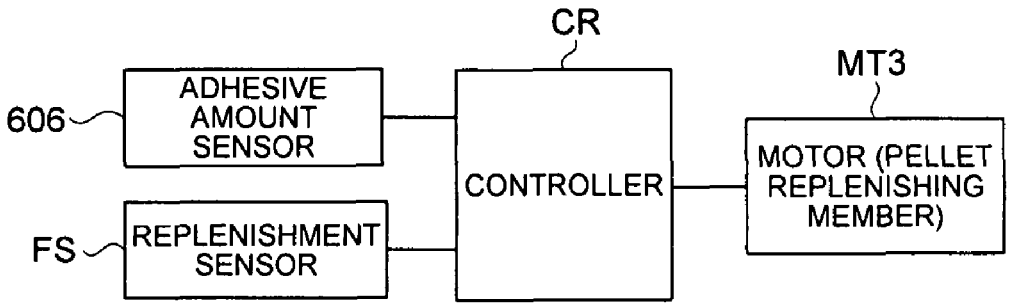
FIG. 8 is a block diagram of the control system that carries out a replenishment control.
Figure 9:
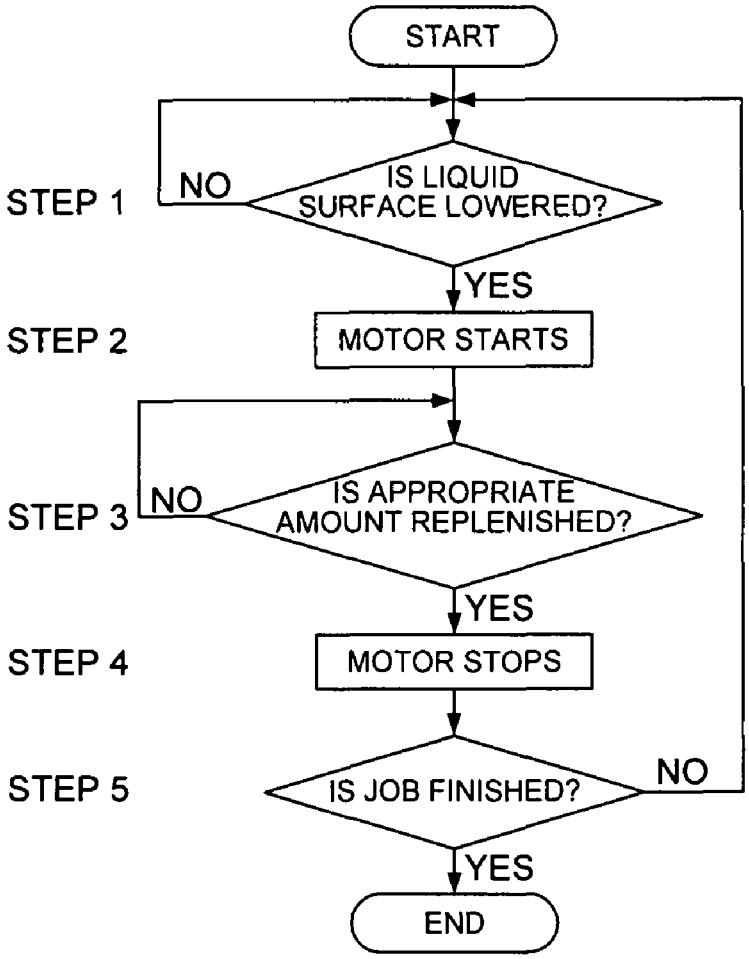
FIG. 9 is a flow chart of the replenishment control carried out by the controller CR.

FIG. 8 is a block diagram of the control system that carries out replenishment control, and FIG. 9 is a flow chart of the replenishment control carried out by the controller CR.

In STEP 1 in FIG. 9, the output of the adhesive quantity sensor 606 which is at the home position is monitored, and, based on the liquid surface reduction detection signal of the adhesive quantity sensor 606, in STEP 2, the motor MT3 is started, and the replenishment of pellets is carried out.

In STEP 3, the count value of the replenishment sensor SF is monitored, and when the count value reaches a prescribed value, in STEP 4, the motor MT3 is stopped thereby ending the replenishment.

In STEP 5, the end of the job is monitored, and the operation of replenishment is ended when the job is completed, and the operation is returned to STEP 1 if the job has not ended.

In the control, although one replenishment operation is from STEP 1 to STEP 5, the prescribed value determining the quantity of replenishment in one replenishment operation is changed according to the thickness of the booklet, and the prescribed value is set to a large value when the thickness of the booklet is more.

The thickness of the booklet is obtained from the information of the number of sheets constituting the booklet as set in the operation section of the image forming apparatus A, or, after detecting the thickness of the booklet in the stacking section 50 of FIG. 1, it is obtained from the detected information.

In this manner, by carrying out replenishment control based on the result of detection by the replenishment sensor, during the bookbinding of a thick booklet, when the amount of consumption of the adhesive is large, the pellets of adhesive are replenished accurately according to the amount of consumption.

In the present invention, since the quantity of replenishment of adhesive is detected and the replenishment control is carried out based on the result of detection, not only the quantity of adhesive in the adhesive reservoir is controlled accurately, but also, a control is carried out that corresponds speedily to the changes in the quantity of adhesive in the adhesive reservoir, and hence booklets are prepared with a stable quality.

What is claimed is:

1. A bookbinding apparatus comprising:

a replenishing device having a pellet storing section that stores pellets of adhesive and a replenishing member that takes out the pellets in a countable manner from the pellet storing section;

an adhesive reservoir that melts the pellets replenished from the replenishing member and stores the molten adhesive liquid;

a coating device having a coating member that coats the adhesive scooped up from the adhesive liquid;

a replenishment sensor provided on the replenished device, that detects the number of pellets replenished to the adhesive reservoir; and a controller that controls the replenishing member based on an output of the replenishment sensor and adjusts a quantity of replenishment of the pellet in one replenishment operation to the adhesive reservoir.

2. The bookbinding apparatus of claim 1, wherein the replenishment sensor outputs a signal proportional to the number of pellets replenished.

3. The bookbinding apparatus of claim 1, wherein the replenishing member comprises a belt which conveys the pellets.

4. The bookbinding apparatus of claim 3, wherein the belt comprises a conveyance surface having concave-and-convex portions.

5. The bookbinding apparatus of claim 3, wherein the replenishing member comprises an opening forming section which forms a narrow first opening to block ejection of the pellets and a second opening wider than the first opening to eject the pellets.

* * * * *